US009845555B1

(12) United States Patent
Usher, Jr.

(10) Patent No.: US 9,845,555 B1
(45) Date of Patent: Dec. 19, 2017

(54) STRETCH SPUN YARN AND YARN SPINNING METHOD

(71) Applicant: Parkdale, Incorporated, Gastonia, NC (US)

(72) Inventor: Robert Alton Usher, Jr., Charlotte, NC (US)

(73) Assignee: PARKDALE, INCORPORATED, Gastonia, NC (US)

( * ) Notice: Subject to any disclaimer, the term of this patent is extended or adjusted under 35 U.S.C. 154(b) by 0 days.

(21) Appl. No.: 14/823,079

(22) Filed: Aug. 11, 2015

(51) Int. Cl.
*D02G 3/04* (2006.01)
*D02G 3/32* (2006.01)

(52) U.S. Cl.
CPC ..... *D02G 3/04* (2013.01); *D02G 3/32* (2013.01); *D10B 2201/02* (2013.01); *D10B 2331/04* (2013.01); *D10B 2401/061* (2013.01); *D10B 2501/00* (2013.01)

(58) Field of Classification Search
CPC ..... D07B 1/00; D07B 1/005; D07B 1/025; D07B 1/02; D07B 2201/2006; D07B 2201/2009; D07B 2201/20015; D07B 2201/202; D07B 2205/00; D07B 2205/10; D07B 2205/103; D07B 2205/20; D07B 2205/2003; D07B 2205/2007; D07B 2205/201; D02G 3/00; D02G 3/02; D02G 3/04; D02G 3/042; D02G 3/32; D03D 3/08; D01F 8/14; D10B 2201/02; D10B 2331/04; D10B 2401/061; D10B 2501/00
See application file for complete search history.

(56) References Cited

U.S. PATENT DOCUMENTS 3,454,460 A 7/1969 Bosley
3,464,198 A 9/1969 Matsubayashi et al.
3,587,220 A 6/1971 Eggleston
3,671,379 A 6/1972 Evans et al.
3,681,188 A 8/1972 Harris
3,959,962 A 6/1976 Wilding
4,115,989 A 9/1978 Spolnicki
4,157,419 A 6/1979 Mirhej
4,343,334 A 8/1982 Schulze et al.
4,634,625 A 1/1987 Franklin
4,748,705 A 6/1988 Johnson et al.
4,991,387 A 2/1991 Tashiro et al.
5,155,989 A 10/1992 Frey et al.
5,372,885 A 12/1994 Tabor et al.
5,702,658 A 12/1997 Pellegrin et al.
5,723,215 A 3/1998 Hernandez et al.
5,874,372 A 2/1999 Morishita et al.
5,888,914 A 3/1999 Katz
6,458,455 B1 10/2002 Hernandez et al.
6,462,149 B1 10/2002 Tilston et al.
6,485,829 B2 11/2002 Nichols et al.
6,503,623 B1 * 1/2003 Oue et al. ..... D01F 6/62 428/364
6,576,339 B1 6/2003 Cordes et al.
6,648,926 B1 11/2003 Immediato
6,656,586 B2 12/2003 Hartzog et al.
6,680,353 B1 1/2004 Kato et al.
6,694,720 B2 2/2004 Driggars et al.
6,705,069 B1 3/2004 Talley et al.
6,708,529 B2 3/2004 Yamazaki et al.
6,811,873 B2 11/2004 Nadkarni
6,815,060 B2 11/2004 Yuuki
6,877,197 B1 4/2005 Van Trump et al.
6,974,628 B2 12/2005 Van Trump et al.
7,036,299 B2 5/2006 Hietpas et al.
7,195,819 B2 3/2007 Hietpas et al.
7,240,476 B2 7/2007 Hietpas et al.
7,310,932 B2 12/2007 Liao
7,310,933 B2 12/2007 Hietpas et al.
7,357,985 B2 4/2008 Kurian et al.
7,461,499 B2 12/2008 Liao
7,615,173 B2 11/2009 Van Trump
7,637,091 B2 12/2009 Liao
7,776,771 B2 8/2010 Autran et al.
7,927,530 B2 4/2011 Dahringer et al.
8,513,146 B2 8/2013 Hietpas et al.
8,895,459 B2 11/2014 Dahringer et al.
2002/0077013 A1 * 6/2002 Hernandez et al. ... D01D 5/253 442/304
2004/0067707 A1 4/2004 Hamilton et al.
2004/0099984 A1 5/2004 Chang et al.
2006/0128243 A1 * 6/2006 Kong et al. ..... A41D 31/00 442/182
2006/0228964 A1 * 10/2006 Watkins et al. ..... D06F 35/00 442/94
2007/0055015 A1 3/2007 Flood et al.
2007/0122614 A1 5/2007 Peng et al.
2009/0173055 A1 7/2009 Silver
2009/0183487 A1 7/2009 Simmonds
2010/0180563 A1 7/2010 Nadkarni et al.
2013/0023177 A1 1/2013 Claasen et al.
2013/0323456 A1 * 12/2013 Seo et al. ..... D01F 6/92 428/97
2014/0223880 A1 8/2014 Henssen

OTHER PUBLICATIONS

Huvis Corporation, Zentra technical information brochure, published prior to Aug. 11, 2015.

* cited by examiner

*Primary Examiner* — Ismael Izaguirre
(74) *Attorney, Agent, or Firm* — Trego, Hines & Ladenheim, PLLC

(57) ABSTRACT

A spun yarn includes a bicomponent staple fiber comprising poly(trimethylene terephthalate) and cotton staple fiber, where the poly(trimethylene terephthalate) is present at a level of at least 1 wt % and less than 20 wt % based on total weight of the spun yarn.

9 Claims, No Drawings

STRETCH SPUN YARN AND YARN SPINNING METHOD

BACKGROUND OF THE INVENTION

This invention relates generally to textiles and more particularly to stretch yarns and methods for making stretch yarn.

For certain types of clothing it is considered desirable to use fabrics exhibiting "stretch" properties, i.e. the ability to be extended under a relatively low force and to elastically return to the original shape and size. Stretch properties may be imparted by the type of fabric construction, such as knitting, and also by incorporating yarns which themselves have stretch properties.

It is known to make stretch fibers using urethane chemistry. One well-known stretch fiber is a polyester-polyurethane copolymer, sold under brand names such as SPANDEX. This fiber (in the form of a filament yarn) is often blended with or used alongside other fibers such as cotton or polyester to make fabrics and clothing. While effective to provide stretch properties, it has a high cost.

Accordingly, there have been attempts to make stretch yarns from other synthetics, in particular blends of bicomponent fibers comprising poly(ethylene terephthalate), also referred to as "PET", and poly(trimethylene terephthalate), also referred to as "PTT". Such fibers have a much lower cost that urethanes. However, these are still more expensive than cellulosic staple fibers (e.g. cotton) or other natural staple fibers. In the prior art it has been believed that relatively large amounts of such fibers are required to achieved adequate stretch properties in yarn.

Accordingly, there remains a need for a stretch yarn utilizing minimal amounts of synthetic fibers.

BRIEF DESCRIPTION OF THE INVENTION

This need is addressed by a blended stretch yarn suitable for making fabrics.

DETAILED DESCRIPTION OF THE INVENTION

The yarn described herein may be spun from an intimate blend of a synthetic bicomponent fiber and natural staple fibers (such as cotton, linen, wool, or silk staple fibers), in a standard short-staple fiber drawing and spinning process.

The bicomponent fiber is a stretch staple fiber comprising poly(trimethylene terephthalate) ("PTT") and another polymer such as poly(ethylene terephthalate) ("PET"). In a preferred embodiment, the bicomponent fiber has a side-by-side cross-sectional shape, with a weight ratio of the two components of approximately 50/50. Suitable fibers having these characteristics are available under the name ZENTRA from HUVIS of Seoul, Korea.

Blending of the bicomponent fiber with natural staple fibers can be accomplished by weight in the opening process described below, or by other known methods effective to produce an intimate blend of the two fibers.

The exact proportions of the bicomponent and natural staple fibers may be varied to suit a particular end use. It is believed that the majority of the stretch properties are dependent on the presence of PTT in the bicomponent fiber. Yarns made from a fiber blend of a 50/50 bicomponent have been tested at cotton-to-bicomponent ratios of 60/40, 70/30, 80/20, and 90/10. All of those blends demonstrated beneficial stretch properties, characterized by their crimp index measurements. Surprisingly and contrary to the prior art, it has been found that spun yarns made with less than 20% bicomponent fiber (that is, less than 10% PTT when using a 50/50 bicomponent fiber) have desirable stretch properties. Testing supports the reasonable conclusion that having PTT present at about 7.5 wt % of the spun yarn provides desirable stretch properties. When PTT is provided in a bicomponent fiber, the PTT/PET ratio could be increased or decreased as long as the percentage of PTT in the finished yarn is maintained. It is further believed that bicomponent fibers containing as little as 1-4 wt % PTT could provide some stretch benefit.

The yarn described above may be manufactured using known short staple yarn manufacturing machinery, an example of which will be briefly summarized. The cotton or other natural staple fibers are introduced in the process in the form of compressed bales. The bales are unstrapped and placed in a specific location under a top feeder machine according to their fiber properties. The top feeder machine traverses back and forth over the bales milling a few millimeters at a time introducing the fibers into the opening and cleaning process.

Since cotton is a natural fiber there are large, medium and fine particles of leaf, stem, trash, and seed coat fragments that must be cleaned from the natural fibers. The fibers are processed through a series of cleaning machines. During the cleaning process, tuft size is progressively reduced facilitating the cleaning and removal of the impurities. Furthermore, there is also a great amount of variation in natural fibers due to differences in the soils and the amount of rain in different cotton growth regions, farming practices and in cotton varieties.

The bicomponent staple fibers are also provided as bales and may be opened and cleaned separately.

Mixing machines are arranged in the cleaning line to receive the opened, cleaned fibers and provide a uniform mixing of the natural and bicomponent fibers.

Properly cleaned, mixed and blended fibers are transferred to carding machines where fibers are separated individually. Very fine trash, dust and foreign matter are removed, and the fibers are arranged in a continuous strand of uniform quality then coiled into a container that allows them to be transported to other processes. The end product of the carding process is sliver, which is a continuous strand of loosely assembled fibers without twist. The production of sliver is the first step in the textile operation that brings staple fiber into a form that can be drawn (or reduced in size) and eventually twisted into a spun yarn.

Multiple and continuous strands of fibers from the carding process are presented to drawing machines where they are passed through a series of rollers to provide further blending and to parallelize the fibers.

This doubling effect helps to blend out variation in the individual strands produced in the previous process. By passing fibers between a series of rollers with increasing speeds the fibers are straightened and made more parallel to the axis of the fiber strand. Also, the input weight is reduced to a weight that can be used by the next process. In addition, electronic devices called autolevelers, are used to reduce and control weight variation and to reduce objectionable imperfections.

Subsequent to drawing, the fibers are spun into yarn. Various spinning processes exist including ring spinning, open end spinning, air-jet spinning, and vortex spinning. Testing has been conducted with ring spinning and open end spinning. Air-jet spinning is believed to be suitable as well. The yarn cotton count and weight may vary to suit a specific end use of the yarn.

The completed yarn is suitable for being made into fabric using known methods. The yarn is especially suitable for being knitted into fabric, for example for use in articles of clothing, and imparts stretch properties to the fabric.

Example

A bicomponent staple fiber having a 50/50 composition of PET and PTT and a side-by-side cross-section was intimately blended with cotton staple fibers. The ratio by weight of cotton to bicomponent was 85/15. The fiber blend was drawn and spun into yarn using the process described above, using open-end spinning. The finished yarn had good stretch properties, with an average percent crimp (tested using industry standard protocols) of 57.5%. The yarn was subsequently knitted into fabric samples. The fabric exhibited desirable stretch properties as well as acceptable dyeing and processing characteristics.

At the same time, the spun yarn's overall cross-sectional properties were largely dominated by the cotton. For example, the elastic recovery, defined as the degree that the yarn will return to its original size after deformation from stress, was quite low. One industry standard, AS-L-1095, measures elastic recovery as a percentage of recovery from elongation of the yarn by 5% of its length. The test yarn of the Example had an average elongation at break of less than 5%, representing essentially no elastic recovery (at 5% elongation). Further testing indicates that any of the yarns described above should have an elastic recovery percentage of elongation (at 5% elongation) of less than 70%.

The foregoing has described a stretch spun yarn and a method for its manufacture. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A spun yarn comprising bicomponent staple fiber comprising poly(ethylene terephthalate) and poly(trimethylene terephthalate) and cotton staple fiber, where the bicomponent staple fiber is present at a level of less than 20 wt % based on total weight of the spun yarn, and wherein the ratio of poly(ethylene terephthalate) to poly(trimethylene terephthalate) is approximately 50/50 by weight.

2. The spun yarn of claim 1 wherein the poly(trimethylene terephthalate) is present at a level of at least 7.5 wt % based on total weight of the spun yarn.

3. The spun yarn of claim 1 wherein the bicomponent staple fiber is present at a level of equal to or less than 15 wt % based on total weight of the spun yarn.

4. The spun yarn of claim 1 wherein the yarn has an elastic recovery percentage of elongation, at 5% elongation, of less than 70%.

5. A spun yarn, comprising:

a bicomponent staple fiber comprising poly(trimethylene terephthalate) and poly(trimethylene terephthalate); and cotton staple fiber;

where the poly(trimethylene terephthalate) is present at a level of at least 1 wt % and less than 10 wt % based on total weight of the spun yarn, and wherein the ratio of poly(ethylene terephthalate) to poly(trimethylene terephthalate) is approximately 50/50 by weight.

6. The spun yarn of claim 5 wherein the poly(trimethylene terephthalate) is present at a level of at least 7.5 wt % based on total weight of the spun yarn.

7. The spun yarn of claim 5 wherein the bicomponent staple fiber is present at a level of equal to or less than 15 wt % based on total weight of the spun yarn.

8. A method of making a spun yarn, comprising:

blending a bicomponent staple fiber comprising poly (trimethylene terephthalate) and poly(trimethylene terephthalate) with cotton staple fiber to produce an intimate fiber blend, where the poly(trimethylene terephthalate) is present at a level of at least 1 wt % and less than 10 wt % based on total weight of intimate fiber blend, wherein the ratio of poly(ethylene terephthalate) to poly(trimethylene terephthalate) is approximately 50/50 by weight; and spinning the intimate fiber blend into a yarn.

9. The method of claim 8 wherein the bicomponent staple fiber is present at a level of equal to or less than 15 wt % based on total weight of the spun yarn.

* * * * *